US010022585B2

(12) United States Patent
Abdourazak

(10) Patent No.: US 10,022,585 B2
(45) Date of Patent: Jul. 17, 2018

(54) MULTI-PURPOSE EXERCISE GLOVE

(71) Applicant: Atteye Houssein Abdourazak, Allentown, PA (US)

(72) Inventor: Atteye Houssein Abdourazak, Allentown, PA (US)

( * ) Notice: Subject to any disclaimer, the term of this patent is extended or adjusted under 35 U.S.C. 154(b) by 68 days.

(21) Appl. No.: 14/843,885

(22) Filed: Sep. 2, 2015

(65) Prior Publication Data

US 2017/0056713 A1 Mar. 2, 2017

(51) Int. Cl.

| | |
|---|---|
| ***A63B 23/14*** | (2006.01) |
| ***A63B 23/16*** | (2006.01) |
| ***A61H 1/00*** | (2006.01) |
| ***A61H 1/02*** | (2006.01) |
| ***A61H 5/00*** | (2006.01) |
| ***A63B 21/00*** | (2006.01) |
| ***A63B 23/12*** | (2006.01) |
| ***A63B 23/035*** | (2006.01) |
| *A63B 21/02* | (2006.01) |

(52) U.S. Cl.

CPC ..... *A63B 21/4039* (2015.10); *A63B 21/0004* (2013.01); *A63B 21/4019* (2015.10); *A63B 23/03508* (2013.01); *A63B 23/12* (2013.01); *A63B 23/14* (2013.01); *A63B 23/16* (2013.01); *A63B 21/028* (2013.01)

(58) Field of Classification Search

CPC ..... A63B 23/129; A63B 23/12; A63B 23/14; A63B 23/16; A63B 21/4017; A63B 21/4019; A63B 21/4021; A63B 21/4023; A63B 21/4025; A63B 21/4035; A63B 23/028; A61H 1/0285; A61H 1/0288; A61H 2205/065; A61H 2205/067; A61H 15/0085; A61H 15/0092; A41D 13/08; A41D 13/081; A41D 13/082; A41D 13/084; A41D 13/085; A41D 13/087

See application file for complete search history.

(56) References Cited

U.S. PATENT DOCUMENTS

| | | | | | |
|---|---|---|---|---|---|
| 645,408 | A | * | 3/1900 | Potter | A62B 18/04 128/201.16 |
| 2,461,695 | A | * | 2/1949 | McMahon | A45D 29/22 132/73 |
| 2,845,628 | A | * | 8/1958 | Dell | A63B 71/148 2/20 |
| D192,927 | S | * | 5/1962 | Ernst | D21/684 |
| 3,129,939 | A | * | 4/1964 | Stock | A63B 23/16 482/49 |
| 3,581,740 | A | | 6/1971 | Sherbourne | |
| 3,612,521 | A | | 10/1971 | Wendeborn | |
| 4,182,072 | A | * | 1/1980 | Much | A63H 33/065 220/4.24 |
| 4,183,100 | A | * | 1/1980 | De Marco | A41D 19/01547 2/159 |
| 4,730,827 | A | * | 3/1988 | Williams | A63B 23/16 482/122 |
| 4,815,729 | A | | 3/1989 | Stefanski | |

(Continued)

OTHER PUBLICATIONS

PCT Search Report for PCT/US2016/043813 dated Jan. 30, 2017.

*Primary Examiner* — Nyca T Nguyen

(57) ABSTRACT

An exercise glove for strengthening the muscles of the hand, wrist, fingers and forearm through full, natural ranges of motion, while providing a tightening grip of the hand on objects.

13 Claims, 9 Drawing Sheets

(56) References Cited

U.S. PATENT DOCUMENTS 4,828,249 A * 5/1989 Keating ..... A63B 23/16 482/121
5,013,030 A * 5/1991 Frins ..... A63B 23/16 482/47
5,062,625 A 11/1991 Vonk
5,076,569 A * 12/1991 Gootter ..... A63B 23/03508 482/49
5,136,911 A 8/1992 Wyss
5,366,436 A 11/1994 Gibney
5,403,008 A 4/1995 Mainiero
5,445,582 A * 8/1995 Brown ..... A63B 21/4025 482/124
5,533,949 A 7/1996 Hwang
6,059,694 A 5/2000 Villepigue
6,179,751 B1 1/2001 Clears
6,228,001 B1 * 5/2001 Johnson ..... A63B 21/028 482/44
6,450,924 B1 * 9/2002 Block ..... A63B 21/0004 482/44
D488,843 S 4/2004 Brown
D491,999 S * 6/2004 Scott ..... D22/142
6,817,967 B1 11/2004 Ott et al.
6,986,728 B2 1/2006 Kasun
7,288,051 B1 * 10/2007 Phillips ..... A63B 21/0004 482/124
7,740,561 B2 6/2010 Kupferman
D640,006 S * 6/2011 Helms ..... D28/61
2006/0247102 A1 * 11/2006 Kupferman ..... A63B 21/0004 482/44
2009/0156367 A1 6/2009 Harris, Jr. et al.
2010/0287736 A1 * 11/2010 Ameduri ..... A63B 49/08 16/430
2011/0281688 A1 * 11/2011 Harris, Jr. ..... A63B 21/0428 482/44
2013/0316877 A1 11/2013 Scire
2014/0135179 A1 * 5/2014 Trent ..... A63B 21/4025 482/47
2014/0207039 A1 * 7/2014 Lane ..... A61F 5/0118 602/21

* cited by examiner

MULTI-PURPOSE EXERCISE GLOVE

FIELD OF THE DISCLOSED TECHNOLOGY

The disclosed technology relates generally to a device and method of use of a glove used to exercise the hand, wrist, fingers and forearm, and more particularly, an exercise glove using the complete natural range of motion to strengthen those muscles. The exercise glove also provides the user with a better grip of an object.

BACKGROUND OF THE DISCLOSED TECHNOLOGY

Exercise devices that strengthen hands, wrists, fingers, and forearms are well known. Many of these devices are a bit complicated to place on the hand. These devices also tend to have the thumb in a very unnatural posture. Furthermore, many of the prior art devices do not add the advantage of acting as a grip-tightening feature when the wearer uses the glove to pick up or hold another object, such as an additional exercise device.

The current technology has the thumb in a natural position with respect to the rest of the hand, and is placed on the fingers as simply as putting on a glove. The natural placement of the thumb allows the exercises to use the complete natural range of motion The disclosed technology also has a tightening grip feature which is very helpful in using this glove with other exercise equipment or the like. The palm and backside of the current technology has another advantage of an indicia area for advertising.

After the current technology is placed on the hand, it allows for the hand to rest in a position of complete flexion and adduction. A hand making a first is in the position of complete flexion and adduction. When exercising using this device, the fingers and thumb are fully extended and abducted against the resistance of the glove material allowing for maximum exercise potential of the hand. Also maximum benefits for exercising the muscles of the hand, fingers and forearm. Prior art hand exercise devices do not allow for complete flexion and adduction at rest with motion to full extension and abduction when performing exercises using the device.

Another feature of the current technology is the unique design of the device in a one-piece glove configuration and in an alternative embodiment the device covers the forearm all the way to the elbow.

Accordingly, there exists the need for new and useful methods and devices for exercising the hand. It is, therefore, to the effective resolution of the aforementioned problems and shortcomings of the prior art that the disclosed technology is directed.

SUMMARY OF THE DISCLOSED TECHNOLOGY

The disclosed technology described herein addresses an unfulfilled need in the prior art by providing a device and method for exercising hands and more particularly a glove as an exercise device where the natural rest position is a first which allows maximum and natural extension while exercising a hand One objective of the disclosed technology is to have a hand exercise glove comprising a body for receiving a hand having a flat palm side face and a flat backside face, the body further comprising four ports for fingers in one plane. The body having a thumb port in a fixed position at an angle ranging from greater than 0 to 120 degrees in a vertical plane perpendicular to finger ports.

Another objective is to have a hand exercise glove wherein the thumb port is fixed at a 90-degree angle in a vertical plane perpendicular to the finger ports. The hand exercise glove wherein the thumb port is either a circular or semi-circular aperture. The hand exercise glove wherein the device is a single integrated molded structure made of a rubber like material. The hand exercise glove is a single integrated molded structure made of an elastomeric rubber.

In yet another objective, the hand exercise glove is used for exercising the hand, finger, thumb, wrist and forearm. Alternatively, the glove has a rough palm side surface to provide a tightening grip of the hand on objects. The hand exercise glove wherein the finger ports have different lengths for fitting the natural shape and length of the fingers.

In a further objective of the current technology, the exercise glove covers at least some of the length of the fingers and insertion of the thumb into the thumb port is only possible when the fingers are flexed. The glove further comprises a central component for receiving the palm of the hand, and a wrist cuff component for placement around a wrist of the hand, which extends the glove to the wrist.

Alternatively, the hand exercise glove further comprises a central component for receiving the palm of the hand, and cuff component for placement on a forearm extending proximally to a point on the forearm anywhere from a wrist to an elbow.

It is also an object of the disclosed technology that a method of using the hand exercise is that the distance between the thumb and the thumb port is such that the full insertion of the thumb into the thumb port is only possible when the fingers are flexed. Another method of using the glove comprises placing fingers of a hand into the finger ports, then flexing the fingers and inserting a thumb of the same hand into the thumb port.

Another objective is to exercise with the glove wherein a hand in the glove starts from a resting position of flexion and adduction. Then extending and abducting the fingers and thumb against the resistance of the glove to a point where they are in the same plane as the hand. The fingers and thumb are then brought back to flexion and adduction in the resting position. This whole cycle is then repeated.

In a final objective, another exercise with the glove wherein the hand in the glove starts from a resting position of flexion and adduction and then extending and abducting the fingers and thumb against the resistance of the glove to a point where they are in the same plane as the hand. Also then combining this movement with complete extension and abduction posteriorly toward the wrist. The fingers and thumb are then brought back to flexion and adduction in the resting position. This whole cycle is then repeated.

In accordance with these and other objectives, which will become apparent hereinafter, the disclosed technology will now be described with particular reference to the drawings.

Figure 1:
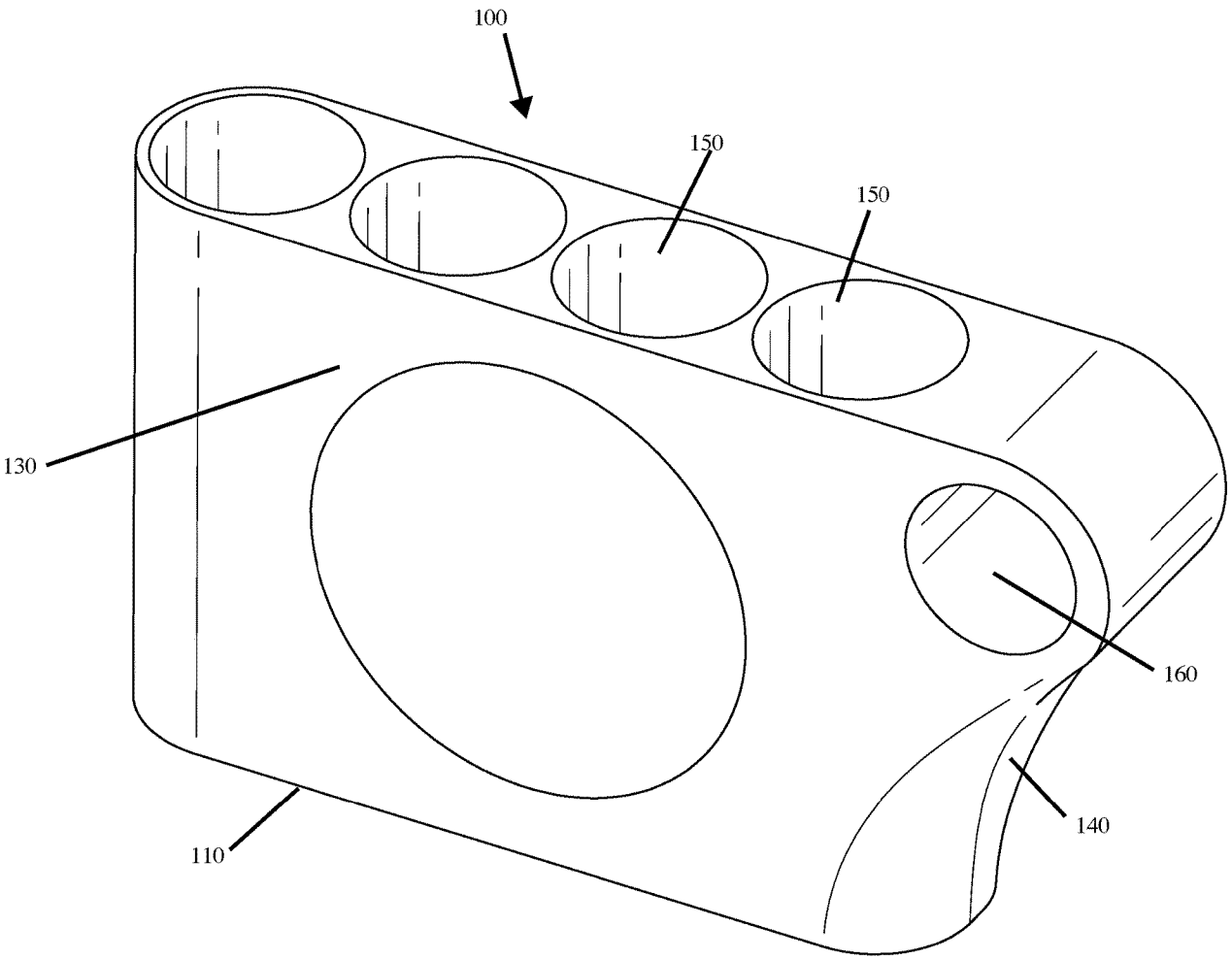
FIG. 1 shows a perspective top view of the exercise glove of the disclosed technology.
Figure 2:
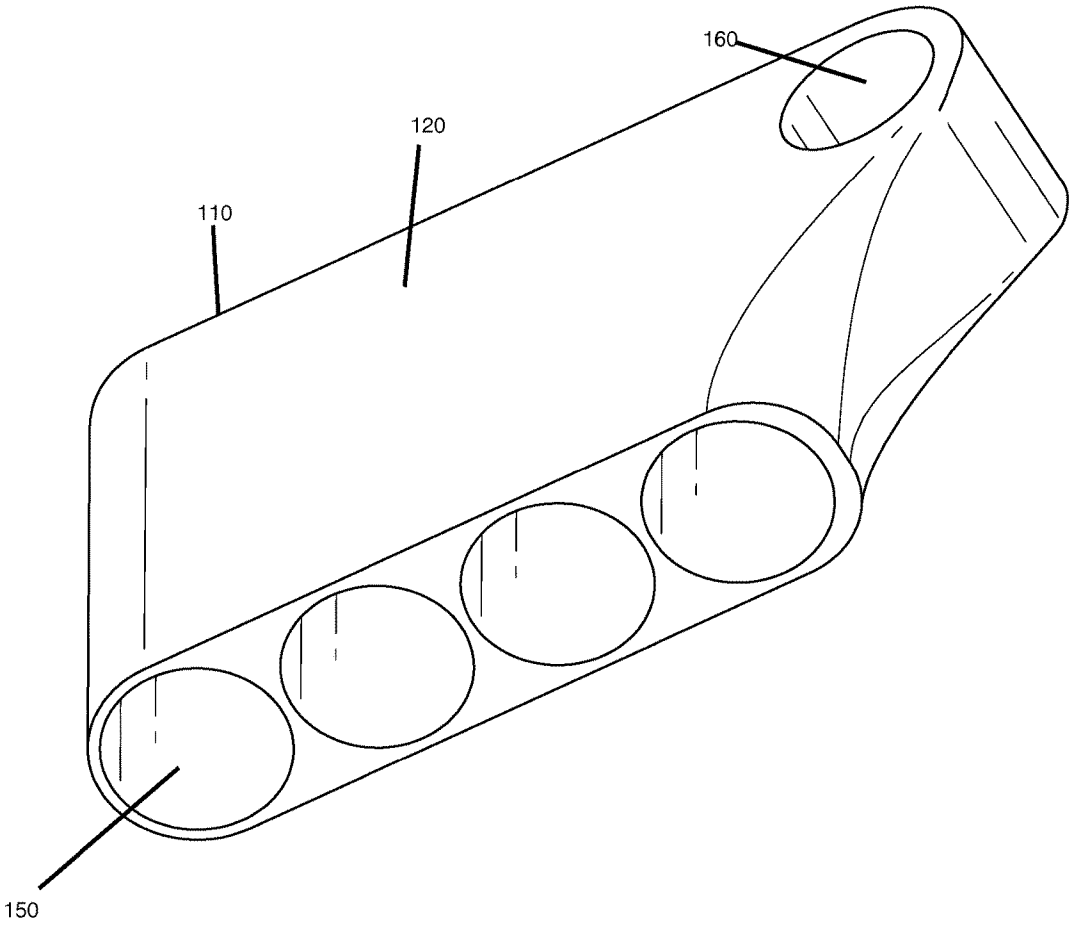
FIG. 2 shows a perspective bottom view of the exercise glove of the disclosed technology.

A better understanding of the disclosed technology will be obtained from the following detailed description of the preferred embodiments, taken in conjunction with the drawings and the attached claims.

DETAILED DESCRIPTION OF EMBODIMENTS OF THE DISCLOSED TECHNOLOGY

The ensuing detailed description provides preferred exemplary embodiments only, and is not intended to limit the scope, applicability, or configuration of the disclosed technology. Rather, the ensuing detailed description of the preferred exemplary embodiments will provide those skilled in the art with an enabling description for implementing the preferred exemplary embodiments of the technology. Various changes may be made in the function and arrangement of elements without departing from the spirit and scope of the disclosed technology, as set forth in the appended claims.

To aid in describing the disclosed technology, directional terms may be used in the specification and claims to describe portions of the present technology (e.g., upper, lower, left, right, etc.). These directional definitions are merely intended to assist in describing and claiming the disclosed technology and are not intended to limit the disclosed technology in any way. In addition, reference numerals that are introduced in the specification in association with a drawing figure may be repeated in one or more subsequent figures without additional description in the specification, in order to provide context for other features.

With reference now to the drawings, a device is shown for exercise glove.

Referring now to FIG. 1, reference number 100 refers generally to an exercise glove device. Exercise glove device 100 is shown and comprises a glove body 110 for receiving a user's fingers. (For purposes of this disclosure, a glove, such as "exercise glove device 100" may refer to a left-handed glove, a right-handed glove, or a pair of gloves.)

The glove body 110 has a palm side face 120, a backside face 130, and a thumb lateral side region 140. The glove body 110 further comprises four-finger ports 150 extending through the glove body 110 for placement of the user's fingers. Thumb port 160 is located at the thumb lateral side region 140. In this embodiment of the exercise glove, the thumb port 160 is a circular aperture. In this embodiment the glove body 110 does not extend to cover the actual palm of a hand. Another embodiment of the disclosed technology is that at least one of the finger and thumb ports are not ports but cavities closed at the tips of the fingers.

Figure 3:
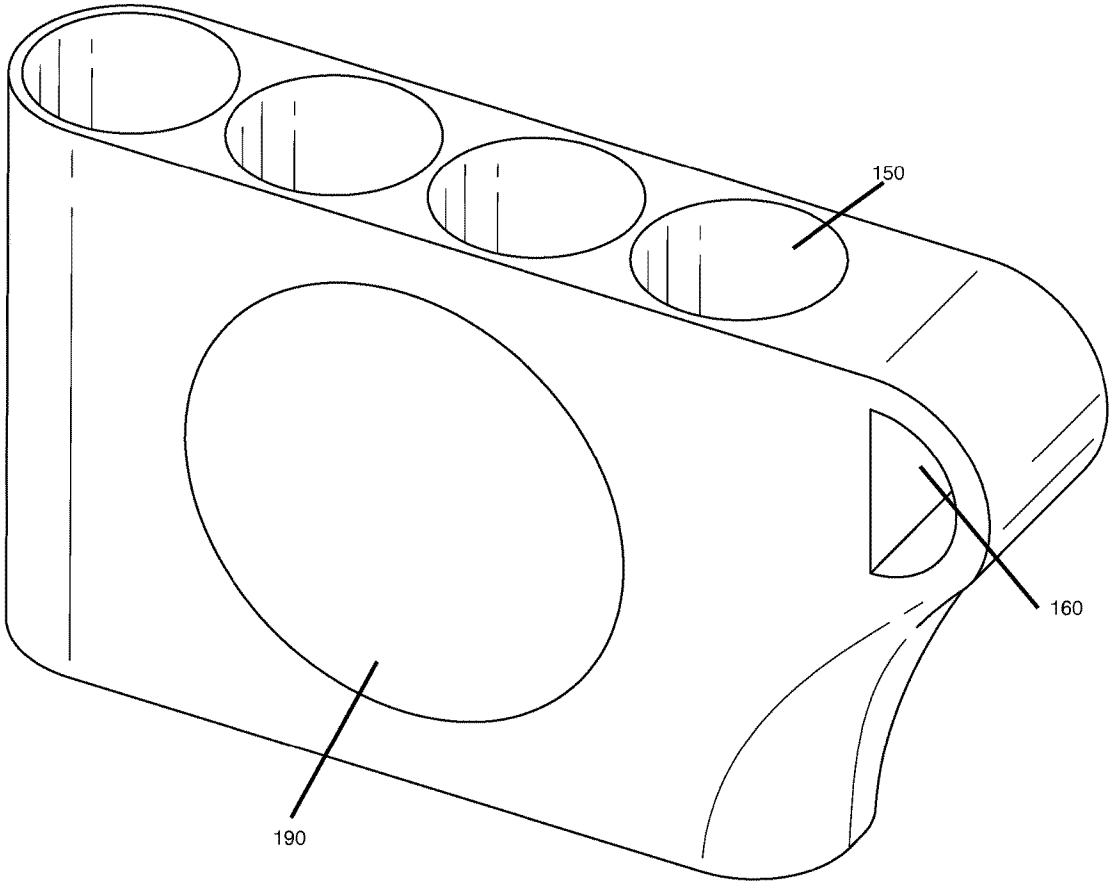
FIG. 3 is a perspective top view of a second embodiment of the exercise glove of the disclosed technology.
Figure 4:
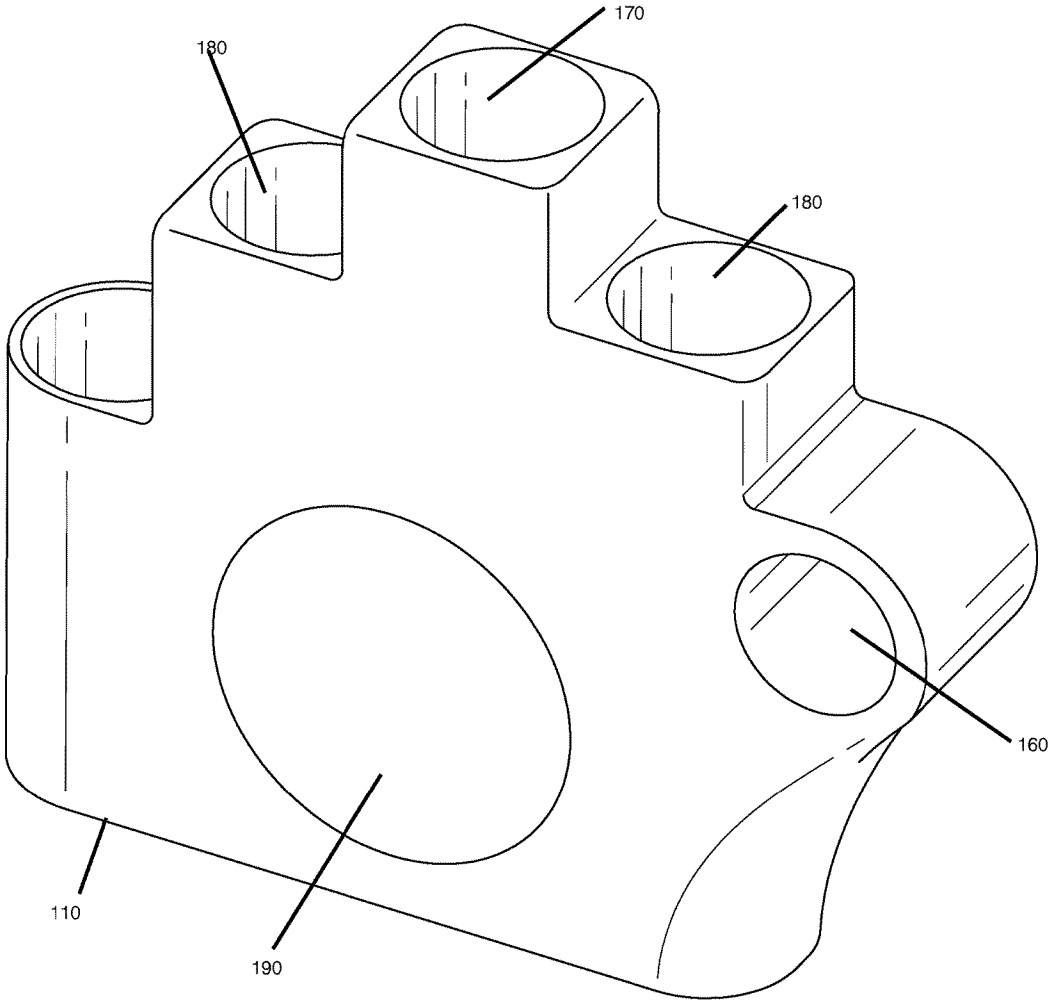
FIG. 4 is a perspective top view of a third embodiment of the exercise glove of the disclosed technology.

Referring to now to FIG. 3 the thumb port 160 is a semicircular port or aperture. FIG. 4 is another embodiment of the current technology. In this embodiment finger ports 150 are modified so that middle finger now has port extension 170 and still is a one-piece glove 100 as part of the body of the glove 110. Ring and pointer fingers 180 also have an extension as part of the glove body 110. This embodiment allows the glove body 110 and finger ports 150 to follow the natural finger configuration.

These port extensions 170 and 180 are any height from the glove body 110 but preferably middle finger port 170 is taller or a longer distance from the glove body 110 than both the pointer and ring finger ports 180. Also in this embodiment pointer and ring finger ports 180 are substantially the same height or distance from the glove body 110.

FIGS. 1-4 show an area 190 that is available for putting indicia such as advertisements. Advertisements such as, but not restricted to name, color, logo, emblem and mascot of a team, school, organization or company, or a country flag may be displayed. The indicia, when used, is placed anywhere on the glove body 110 but preferably the flat of the palm side surface 120 or posterior (back) side surface 130. Indicia are either printed on the exercise glove 100 or the exercise glove can have a pocket with a window to hold indicia.

The port for the thumb 160 is in a fixed position at an angle ranging from greater than 0 to equal or less than 120 degrees in a vertical plane perpendicular to finger ports 150, with 90 degrees being the preferred position of the thumb port 160.

Figure 5:
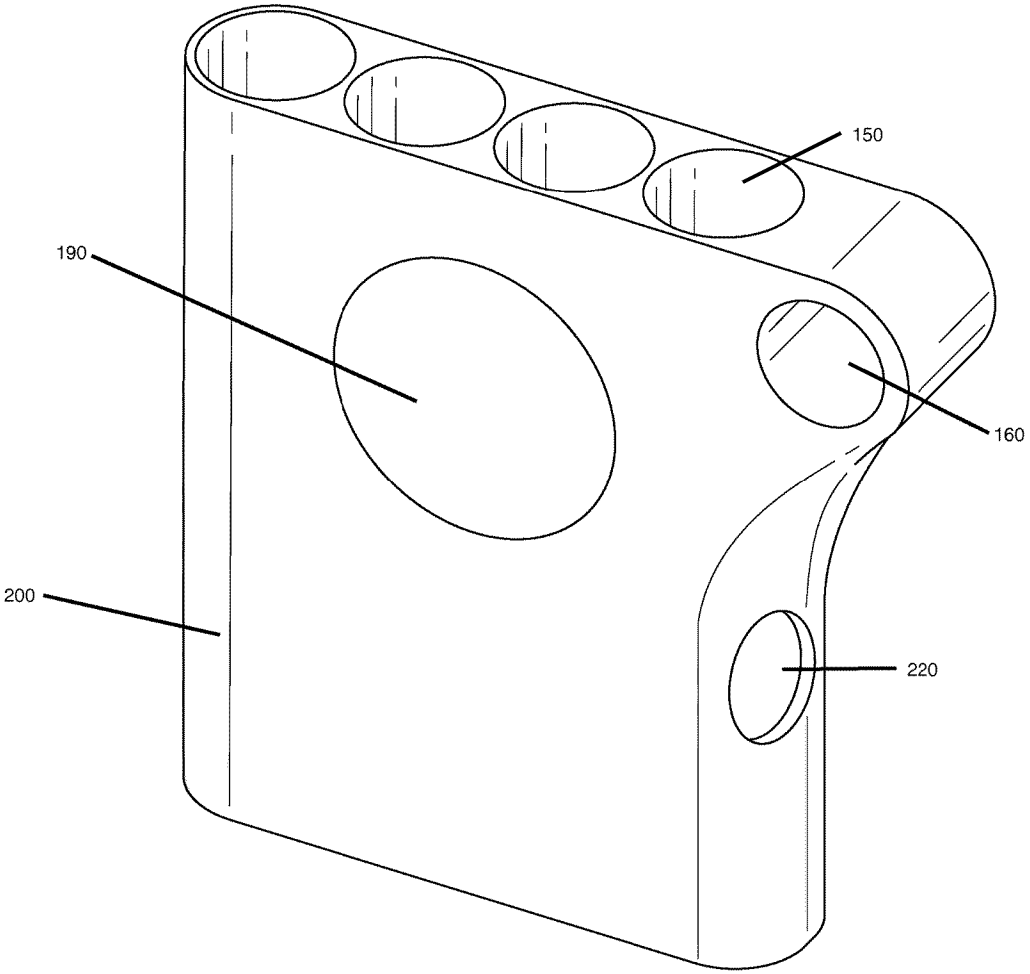
FIG. 5 is a perspective top view of a fourth embodiment of the exercise glove of the disclosed technology.

FIG. 5 shows an embodiment of the exercise glove 100 where the bottom of the glove body 110 is extended below the fingers and covers the palm of a person's hand. The glove body 110 in this embodiment further comprises a central component 200 for receiving the palm of the user's hand, and a wrist cuff component 210 for placement around the user's wrist.

Since the glove body 110 now extends below where a person's thumb would naturally be, there is a thumb aperture 220. Thumb aperture 220 is used for the thumb to go through to be able to then reach thumb port 160. In an alternative embodiment the glove body extends beyond the wrist to a point anywhere on the forearm from the wrist to the elbow. The diameter at the opening cuff component 210 is modified for the extension past the wrist by varying the diameter.

Figure 6:
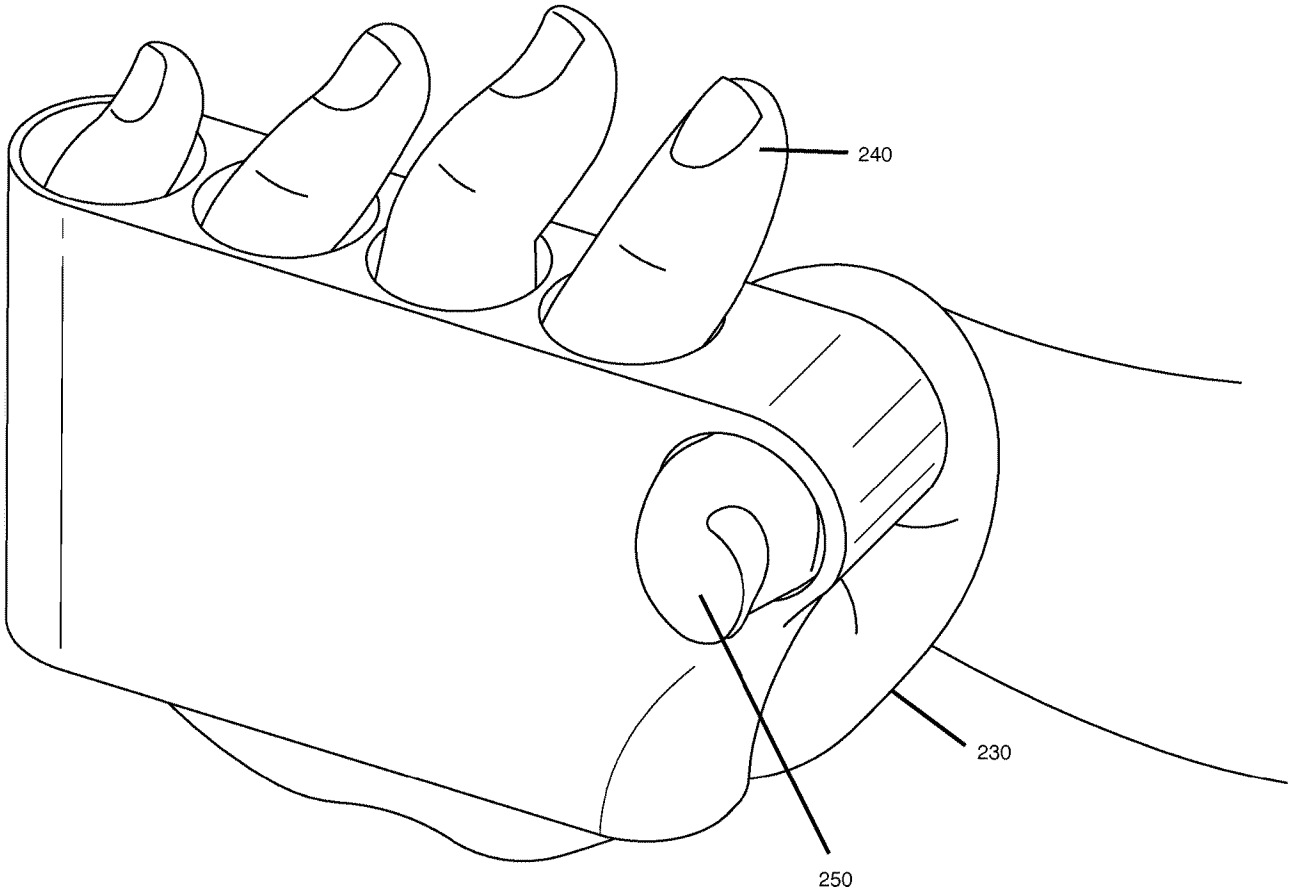
FIG. 6 shows a perspective view of the exercise glove of the disclosed technology with the fingers and thumb inserted.

FIG. 6 is a view of a hand 230 already placed into exercise glove 100. A thumb is inserted into thumb port 160 and the fingers into finger ports 150.

Figure 7:
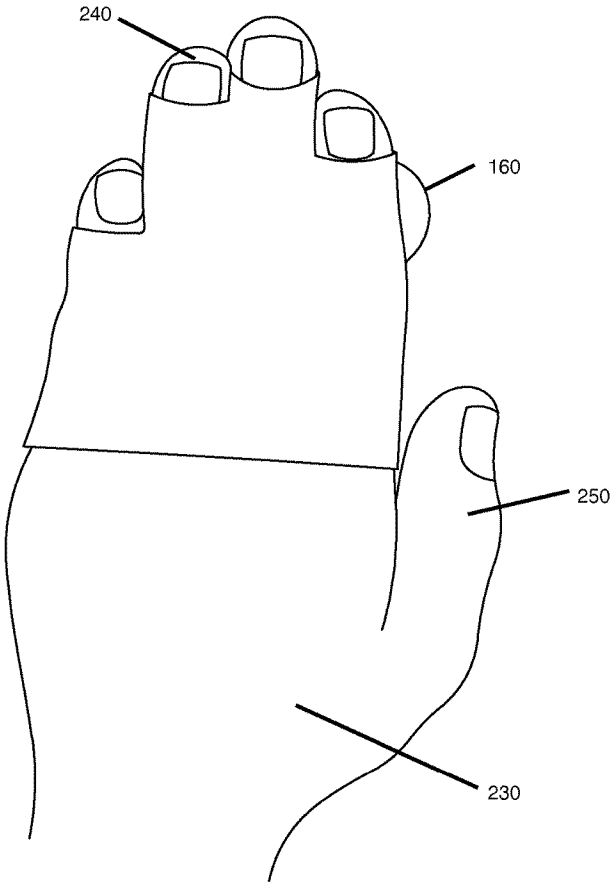
FIG. 7 shows a perspective view of the exercise glove of the disclosed technology with only the fingers inserted.
Figure 8:
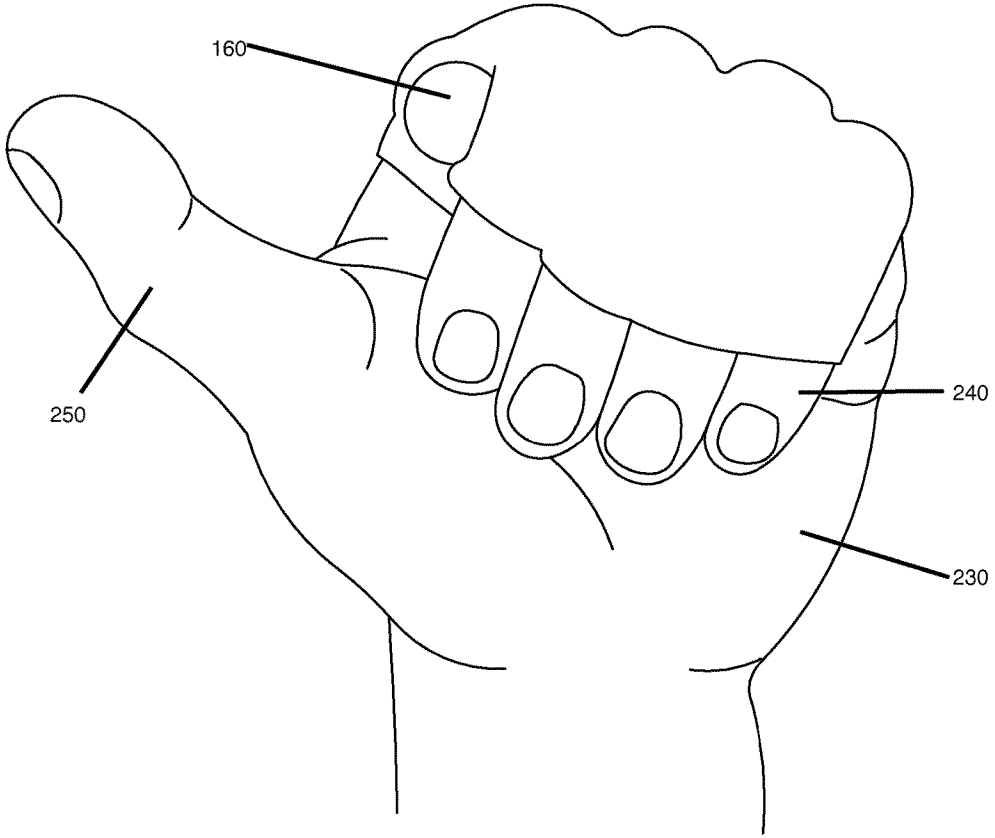
FIG. 8 is a perspective view of the exercise glove of the disclosed technology with only the fingers inserted and now bent to allow thumb insertion.

Now onto FIG. 7. This shows the placement of an exercise glove 100 onto a hand 230. First the finger ports 150 are placed on all four fingers 240 while the fingers are in an upright position. The thumb 250 is not simultaneously engaged with the thumb port 160 yet. The user's fingers 240 must curl down or flex to make insertion of the thumb 250 into the thumb port 160 possible. FIG. 8 shows the fingers flexed down making the thumb port 160 available for placement of the thumb 250. Full insertion of the thumb 250 in the thumb port 160 is only possible when the fingers 240 are flexed toward a first position.

The exercise glove is made of a one-piece, molded, resilient, elastomeric, rubber or rubberlike material. Another use of the exercise glove is to enhance an athlete's or person's grip on sports equipment. A firmer grip of the hand on objects such as but not restricted to baseball and cricket bats, a ball such as baseball, basketball, handball, or weights to name a few.

In another embodiment, the smooth and flat surface of the palm side is modified such as to provide rougher surface with more surface area for contact with objects to provide the firmer grip. Another aspect of the disclosed technology is gripping while the hand is in a stretched position; the device provides a firmer grip on an object due to the tendency of the resilient material to try to recoil. Also, when the hand is in a stretched position a greater surface area of contact and hence greater transfer of energy of the movement of the hand are in play.

Figure 9:
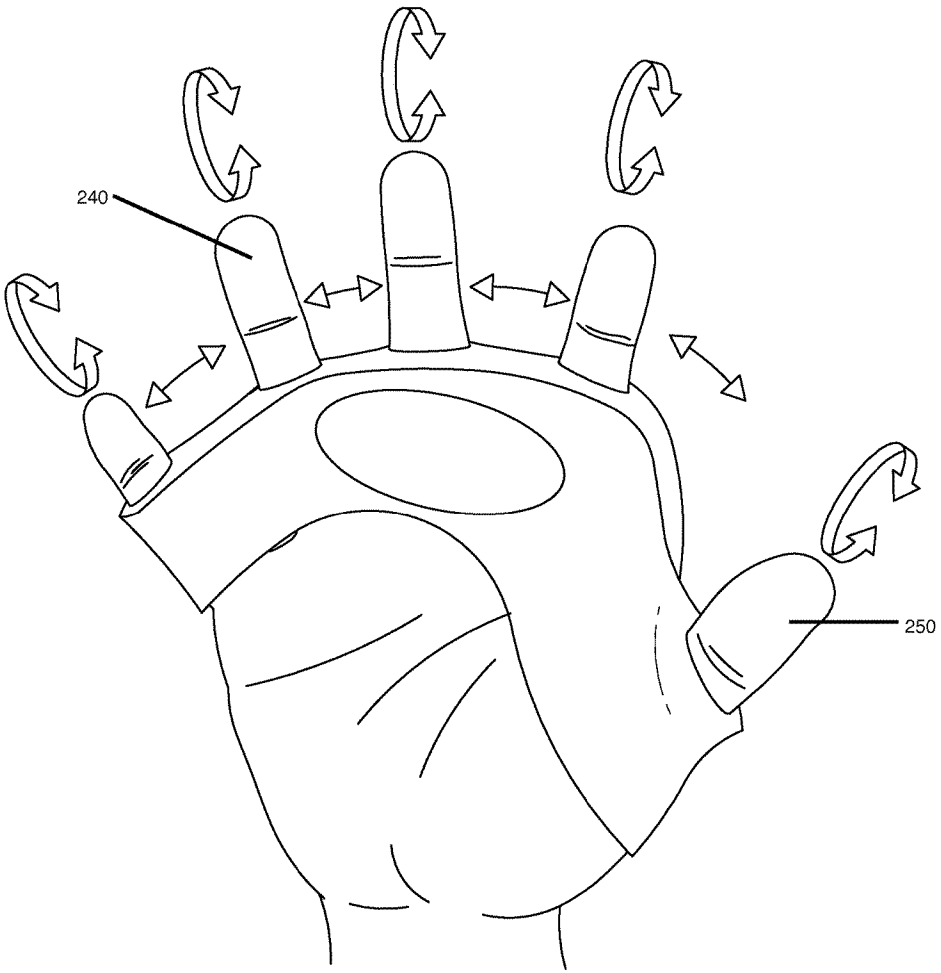
FIG. 9 shows a perspective view of a thumb and fingers fully inserted and using the disclosed technology to exercise.

FIG. 9 shows the different movements the hand makes to exercise the hand. After the current technology is placed on the hand, it allows for the hand to rest in a position of complete flexion and adduction. A hand making a first is in complete flexion and adduction. When exercising using this device, the fingers and thumb are fully extended and abducted against the resistance of the glove material allowing for maximum exercise potential of the hand. Also maximum benefits for exercising the muscles of the hand fingers and forearm. Prior art hand exercise devices do not allow for this complete motion from full flexion and adduction to fully extension and abduction. The resistance of the material is modified by independently varying the thickness of the material in-between and around the finger ports 150 and thumb port 160

The method of using the glove for exercise comprises a first exercise starting from a resting position or complete flexion and adduction and stretching the fingers and thumb in a plane lateral to the plane of the fingers. Another second method of exercise consists of combining a lateral stretching movement and a rear movement towards the posterior surface of the fingers and thumb without movement of the wrist.

In another method of exercise with exercise glove 100, the hand 230 is in a stretched position where the fingers 240 and thumb 250 are completely extended and abducted against the resistance of the glove 100. The fingers 240 and thumb 250 are then brought back to complete flexion and adduction and this cycle is repeated.

The disclosed technology would be great exercise for athletes in sports like golf, tennis/rackets sports, baseball, basketball, hockey, football, climbing, motor sports (motorcross, jet-ski, snowmobile, auto-racing, etc.), bowling, cricket, martial arts, body building, sailing, arm-wrestling, to name a few. Another application is for physical therapy (carpel tunnel, repetitive motion injuries, weak muscles and joints, arthritis, post surgical weakness, and by anyone wishing to exercise the hand, fingers, wrist and forearm.

It is recognized by those skilled in the art that changes may be made to the above-described embodiments of the disclosed technology without departing from the broad inventive concept thereof. It is understood, therefore, that this technology is not limited to the particular embodiments disclosed, but is intended to cover all modifications, which are in the spirit and scope of the disclosed technology.

I claim:

1. A hand exercise glove comprising:

a. a body for receiving a hand, said body having a flat palm side face and a flat backside face;

b. four circular finger ports, said ports being defined in said body, wherein circular cross sections of said finger ports are in a single plane; and c. a circular thumb port defined in said body, said thumb port being in a fixed position relative to said four circular finger ports, wherein a circular cross section of said thumb port is perpendicular to said circular cross sections of said finger ports, and wherein said circular cross section of said thumb port is parallel to at least one of said flat palm side face and said flat backside face, and wherein said circular cross sections of said finger ports are perpendicular to at least one of said flat palm side face and said flat backside face.

2. The hand exercise glove of claim 1, wherein the thumb port is a semi-circular aperture.

3. The hand exercise glove of claim 1, wherein the glove is a single integrated molded structure made of a rubber material.

4. The hand exercise glove of claim 1, wherein the glove is a single integrated molded structure made of an elastomeric rubber.

5. The hand exercise glove of claim 1, wherein the glove is used for exercising the hand, finger, thumb, wrist and forearm.

6. The hand exercise glove of claim 1, wherein the finger ports have different lengths for fitting the natural shape and length of the fingers.

7. The hand exercise glove of claim 1, wherein the glove is adapted to cover at least some length of the fingers, when donned, and wherein said fixed position of said thumb port relative to said four finger ports is adapted such that, during donning of said glove, a user can only insert a thumb into the thumb port when the fingers, previously inserted into said finger ports, are flexed.

8. The hand exercise glove of claim 1, wherein the glove further comprises a central component for receiving the palm of the hand, and a wrist cuff component for placement around a wrist of the hand, which extends the glove to the wrist.

9. The hand exercise glove of claim 1, wherein the glove further comprises a central component for receiving the palm of the hand, and cuff component for placement on a forearm extending proximally to a point on the forearm anywhere from a wrist to an elbow.

10. The method of using a hand exercise glove comprises:

providing the hand exercise glove comprising:

a. a body for receiving a hand, said body having a flat palm side face and a flat backside face;

b. four circular finger ports, said ports being defined in said body, wherein circular cross sections of said finger ports are in a single plane; and c. a circular thumb port defined in said body, said thumb port being in a fixed position relative to said four circular finger ports, wherein a circular cross section of said thumb port is perpendicular to said circular cross sections of said finger ports, and wherein said circular cross section of said thumb port is parallel to at least one of said flat palm side face and said flat backside face, and wherein said circular cross sections of said finger ports are perpendicular to at least one of said flat palm side face and said flat backside face:

wherein the distance between a thumb and the thumb port is such that full insertion of the thumb into the thumb port is only possible when fingers are flexed.

11. The method of using a glove comprises:

providing the glove comprising:

a. a body for receiving a hand, said body having a flat palm side face and a flat backside face;

b. four circular finger ports, said ports being defined in said body, wherein circular cross sections of said finger ports are in a single plane; and c. a circular thumb port defined in said body, said thumb port being in a fixed position relative to said four circular finger ports, wherein a circular cross section of said thumb port is perpendicular to said circular cross sections of said finger ports, and wherein said circular cross section of said thumb port is parallel to at least one of said flat palm side face and said flat backside face, and wherein said circular cross sections of said finger ports are perpendicular to at least one of said flat palm side face and said flat backside face;

placing fingers of a hand into the finger ports, then flexing the fingers and inserting a thumb of the same hand into the thumb port.

12. The method of claim 11, wherein:

a. the hand in the glove starts from a resting position of flexion and adduction;

b. then extending and abducting the fingers and thumb against the resistance of the glove to a point where they are in the same plane as the hand;

c. and the fingers and thumb are then brought back to flexion and adduction in the resting position;

d. then repeating this cycle.

13. The method of claim 11, wherein:

a. the hand in the glove starts from a resting position of flexion and adduction;

b. then extending and abducting the fingers and thumb against the resistance of the glove to a point where they are in the same plane as the hand;

c. then combining this movement with complete extension and abduction posteriorly toward the wrist;

d. the fingers and thumb are then brought back to flexion and adduction in the resting position;

e. then repeating this cycle.

* * * * *